US005251561A

United States Patent [19]

Murphy

[11] Patent Number: 5,251,561

[45] Date of Patent: Oct. 12, 1993

[54] OPEN APEX SHAPED CHARGE-TYPE EXPLOSIVE DEVICE HAVING SPECIAL DISC MEANS WITH SLIDE SURFACE THEREON TO INFLUENCE MOVEMENT OF OPEN APEX SHAPED CHARGE LINER DURING COLLAPSE OF SAME DURING DETONATION

[75] Inventor: Michael J. Murphy, Livermore, Calif.

[73] Assignee: The United States of America as represented by the United States Department of Energy, Washington, D.C.

[21] Appl. No.: 897,150

[22] Filed: Jun. 11, 1992

[51] Int. Cl.[5] ..... F42B 1/02

[52] U.S. Cl. ..... 102/307; 102/476

[58] Field of Search ..... 102/306, 307, 476

[56] References Cited

U.S. PATENT DOCUMENTS

| | | | |
|---|---|---|---|
| 2,587,243 | 2/1952 | Sweetman | 102/476 |
| 2,796,833 | 6/1957 | Sweetman | 102/476 |
| 3,077,834 | 2/1963 | Caldwell | 102/307 |
| 3,437,036 | 4/1969 | Franzen et al. | 102/307 X |
| 3,478,685 | 11/1969 | Thomanek et al. | 102/307 X |
| 4,594,947 | 6/1986 | Aubry et al. | 102/307 |
| 4,665,826 | 5/1987 | Marer | 102/401 |
| 4,702,171 | 10/1987 | Tal et al. | 102/307 X |
| 4,802,039 | 1/1990 | Emerson et al. | 102/476 |
| 4,817,531 | 4/1989 | Walker et al. | 102/306 |
| 4,896,609 | 1/1990 | Betts et al. | 102/309 |
| 4,922,825 | 5/1990 | Aubry et al. | 102/476 |
| 4,979,443 | 12/1990 | Rittel et al. | 102/307 |
| 5,033,387 | 7/1991 | Lips | 102/306 X |

*Primary Examiner*—Peter A. Nelson

*Attorney, Agent, or Firm*—Miguel A. Valdes; Roger S. Gaither; William R. Moser

[57] ABSTRACT

An open apex shape charge explosive device is disclosed having an inner liner defining a truncated cone, an explosive charge surrounding the truncated inner liner, a primer charge, and a disc located between the inner liner and the primer charge for directing the detonation of the primer charge around the end edge of the disc means to the explosive materials surrounding the inner liner. The disc comprises a material having one or more of: a higher compressive strength, a higher hardness, and/or a higher density than the material comprising the inner liner, thereby enabling the disc to resist deformation until the liner collapses. The disc has a slide surface thereon on which the end edge of the inner liner slides inwardly toward the vertical axis of the device during detonation of the main explosive surrounding the inner liner, to thereby facilitate the inward collapse of the inner liner. In a preferred embodiment, the geometry of the slide surface is adjusted to further control the collapse or $\beta$ angle of the inner liner.

20 Claims, 4 Drawing Sheets

OPEN APEX SHAPED CHARGE-TYPE EXPLOSIVE DEVICE HAVING SPECIAL DISC MEANS WITH SLIDE SURFACE THEREON TO INFLUENCE MOVEMENT OF OPEN APEX SHAPED CHARGE LINER DURING COLLAPSE OF SAME DURING DETONATION

BACKGROUND OF THE INVENTION

The invention described herein arose in the course of, or under, Contract No. W-7405-ENG48 between the United States Department of Energy and the University of California, for the operation of the Lawrence Livermore National Laboratory.

This invention relates to an explosive device having an open apex shaped charge liner therein. More particularly, this invention relates to an open apex shaped charge-type device provided with disc means having slide surface means thereon to influence the collapse of the inner liner during detonation.

Typically explosive devices embodying open apex shaped charge liners, such as shown at 2 in FIGS. 1 and 2, used for example, in armor piercing munitions, are provided with an inner liner 10, defining a truncated cone, surrounded by high explosive material 14 within a casing 6. High explosive material 14, when detonated, causes liner 10 to collapse inwardly or implode, as shown in FIG. 2, resulting eventually in the formation of a jet of material flowing along the axis of the cone. The high explosive is detonated by a primer charge 30, which is ignited by detonator 38. Primer charge 30 and detonator 38 are located at the back or bottom of shell 2 and separated from liner 10 and central portions of high explosive material 14 by a circular disc 20 of material which directs the detonation of primer charge 30 around the edges of disc 20 to cause the outer portions of high explosive 14 to detonate first, forcing inner liner 10 to collapse inwardly or implode to form the desired central jet. Cushioning material 32 and steel disc 34 may be provided behind disc 20 to absorb some of the upward force of the detonation of primer charge 30.

However, as shown in FIG. 2, disc 20, normally used to direct the detonation of primer charge 30 toward the outer edges of high explosive material 14, also has inadvertently functioned, in the prior art, to impede the initial formation of the desired collapse of liner 10 adjacent disc 20, resulting in distortions of the central jet being formed. The reason for this is that central disc 20 is normally formed of a soft material such as lead, or a low density material such as a plastic material, to provide a shock absorbing effect to absorb the shock waves, produced by the detonation of primer charge 30, which emanate in the direction of the axis of the cone.

Because of such material selection, the forces developing at the edges of disc 20, during detonation of high explosive 14, tend to squeeze disc 20 together, which may result in an upward bulge 22 shown in the central portion of disc 20 along the axis of the cone, as shown in FIGS. 2 and 2A (exaggerated for illustrative purposes), which in turn can hinder the development of the desired shaped charge jet by collapse of inner liner 10.

Furthermore, the softness of such prior art materials can cause the bottom edge of collapsing inner liner 10 to gouge into or scarify the surface of disc 20, as shown at 24 in FIGS. 2 and 2A, which further impedes the inner collapse of the bottom portions of inner liner 10, resulting in further uncontrolled distortions of the jet being centrally formed by such collapse.

It would, therefore, be desirable to provide means for directing the primer detonation toward the peripheral portions of the cone shaped high explosive which would not interfere with the subsequent collapse or implosion of the inner liner and resulting development of the desired central shaped charge jet. Furthermore, it would be preferable if the means for redirecting the detonation forces toward the periphery of the high explosive charge would be construction of a type and shape of material which would facilitate collapse of the inner liner during the initial detonation of the high explosive charge, and which could further serve to actually control the collapse angle ($\beta$ angle) of the inner liner, with respect to the central axis of the cone, as the inner liner wall completes its inward collapse.

SUMMARY OF THE INVENTION

It is, therefore, an object of this invention to provide an open apex shape charge explosive device having an inner liner defining a truncated cone with disc means located between the inner liner and a primer charge for directing the detonation of the primer charge around the edges of the disc to explosive materials surrounding the inner liner, and a slide surface on the disc means capable of facilitating collapse of the inner liner as the explosive material surrounding the liner detonates.

It is another object of this invention to provide an open apex shape charge explosive device having an inner liner defining a truncated cone with disc means, comprising a material having a higher compressive strength than the inner liner, located between the inner liner and a primer charge for directing the detonation of the primer charge around the edges of the disc to explosive materials surrounding the inner liner, and a slide surface on the disc mean capable of facilitating collapse of the inner liner as the explosive material surrounding the liner detonates.

It is yet another object of this invention to provide an open apex shape charge explosive device having an inner liner defining a truncated cone with disc means, comprising a material having a higher surface hardness than the inner liner, located between the liner and a primer charge for directing the detonation of the primer charge around the edges of the disc to explosive materials surrounding the inner liner, and a slide surface on the disc means capable of facilitating collapse of the inner liner as the explosive material surrounding the liner detonates.

It is a further object of this invention to provide an open apex shape charge explosive device having an inner liner defining a truncated cone with disc means, comprising a material having a higher density than the inner liner, located between the liner and a primer charge for directing the detonation of the primer charge around the edges of the disc to explosive materials surrounding the inner liner, and a slide surface on the disc means capable of facilitating collapse of the inner liner as the explosive material surrounding the liner detonates.

It is still another object of this invention to provide an open apex shape charge explosive device having an inner liner defining a truncated cone with disc means located between the liner and a primer charge for directing the detonation of the primer charge around the edges of the disc to explosive materials surrounding the inner liner, and a slide surface on the disc means forming an angle with the axis of the cone which may vary from 90° to about the sum of the half angle which the inner liner initially defines with the axis of the cone plus twice the bending angle of the inner liner as the inner liner collapses, which will facilitate collapse of the inner liner as the explosive material surrounding the liner detonates.

These and other objects of the invention will be apparent from the following description and accompanying drawings.

DETAILED DESCRIPTION OF THE INVENTION

Figure 3:
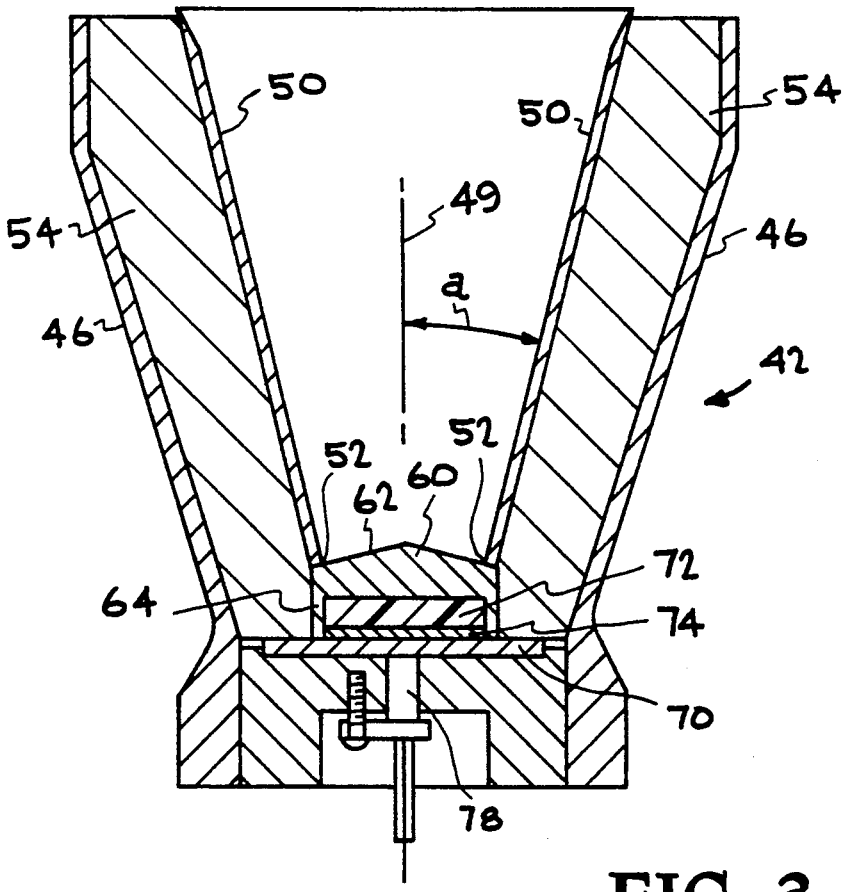
FIG. 3 is a vertical cross sectional view of an open apex space charge explosive device constructed in accordance with the invention prior to detonation.
Figure 4:
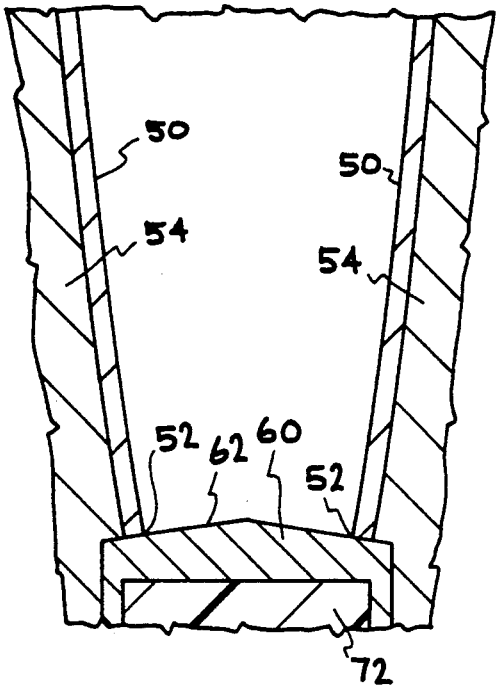
FIGS. 4–8 are fragmentary vertical cross-sectional views of the open apex space charge explosive device of FIG. 3 showing, sequentially, the inward movement of the inner liner as the detonation of the main explosive charge surrounding the inner liner progresses, illustrating the sliding of the end edge of the inner liner over the slide surface of the disc means, toward the central axis, during the collapse or implosion of the inner liner.
Figure 5:
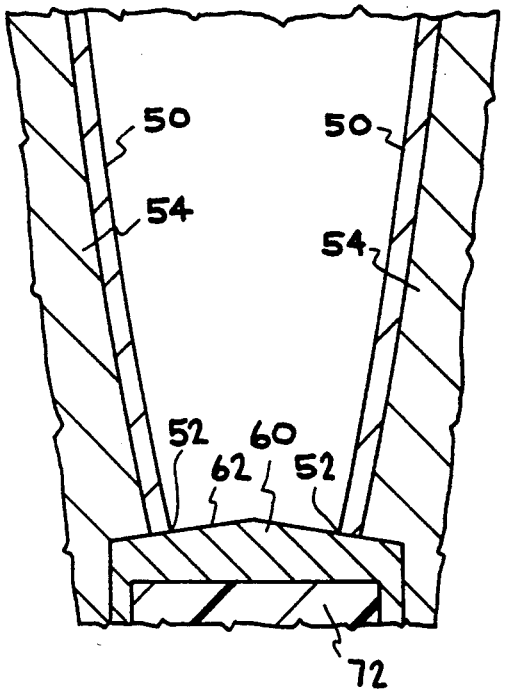
Figure 6:
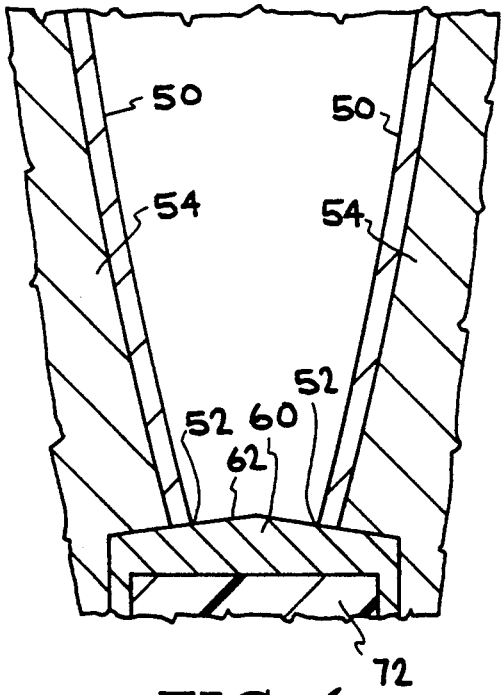
Figure 7:
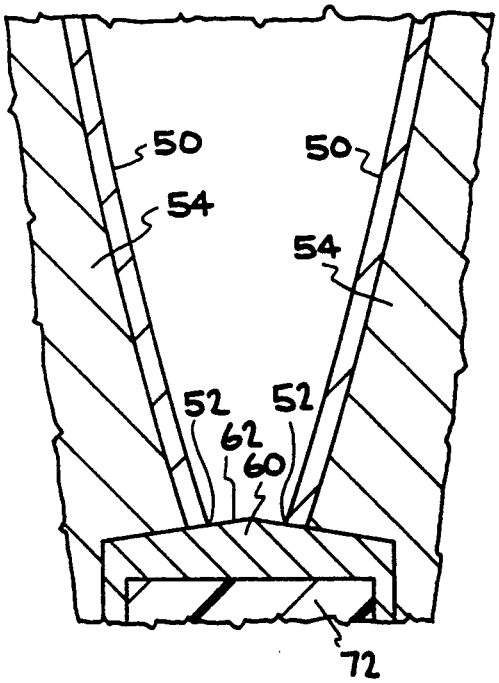

Referring now to FIG. 3 in particular, an explosive device, of the open apex shaped charge-type, which has been constructed in accordance with the invention, is generally shown at 42. Explosive device 42 has an outer casing 46, an inner liner 50 shaped as a truncated cone, and a main explosive charge 54 within casing 46 surrounding inner liner 50.

At the truncated end of the cone comprising inner liner 50 is disc means 60 of the invention, having a slide surface 62 formed thereon. The end edge 52 of truncated cone inner liner 50 rests on this slide surface 62 of disc means 60 and will slide inwardly on this slide surface toward the central axis of device 42 (which is also the vertical axis of inner liner 50 and disc means 60) during subsequent detonation of main explosive charge 54 and resultant collapse or implosion of inner liner 50, to thereby facilitate such implosion in a controlled manner.

Disc means 60 serves to direct the initial central detonation of primer charge 70 by detonator 78 peripherally toward the main explosive charge 54. As in the prior art construction, a compressible material 72 may be optionally provided behind disc means 60 with a steel plate 74 further provided behind compressible material 72 to evenly spread such cushioning of the upward forces across the surface of compressible material 72. Disc means 60 may be provided with a depending skirt 64 to assist in the retention of such compressible material 72. However, it must be noted that both the use of compressible material 72 and the provision of retention skirt 64 on disc means 60 are optional features which form no part of the basic invention herein.

Figure 1:
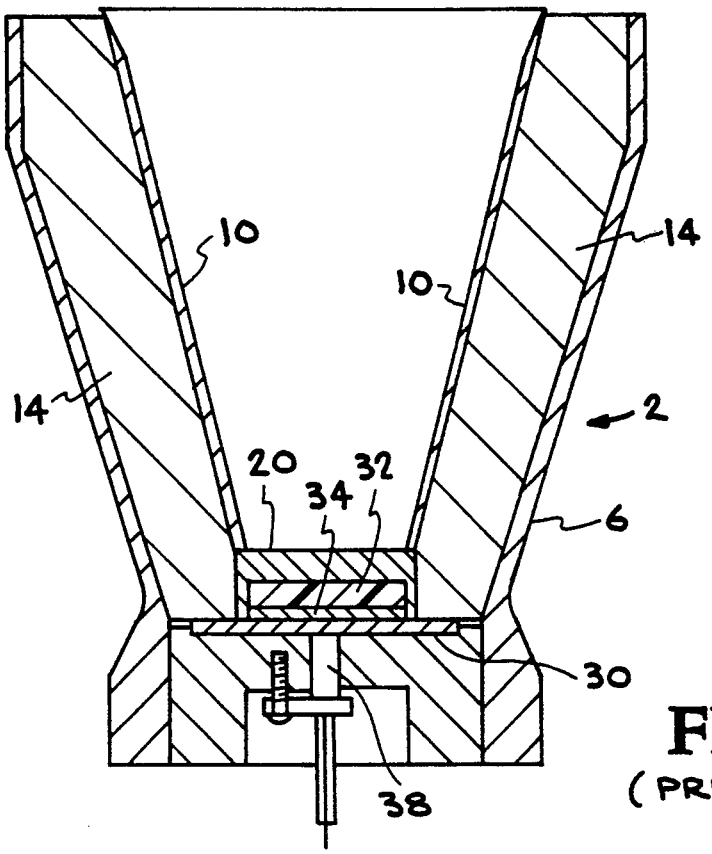
FIG. 1 (PRIOR ART)
FIG. 1 is a vertical cross-sectional view of a typical prior art open apex space charge explosive device.
Figure 2:
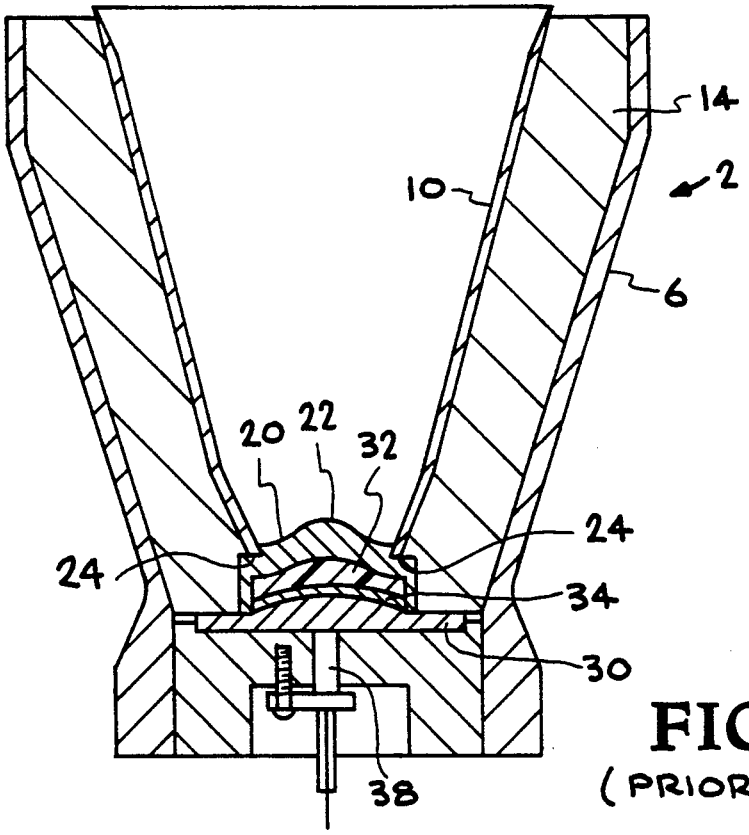
FIG. 2 (PRIOR ART)
FIG. 2 is a vertical cross-sectional view of the prior art open apex space charge explosive device of FIG. 1 after initial detonation, showing the upward bulging of the central portion of the disc, as well as the inward movement of the inner liner gouging into the surface of the disc.
Figure 2A:
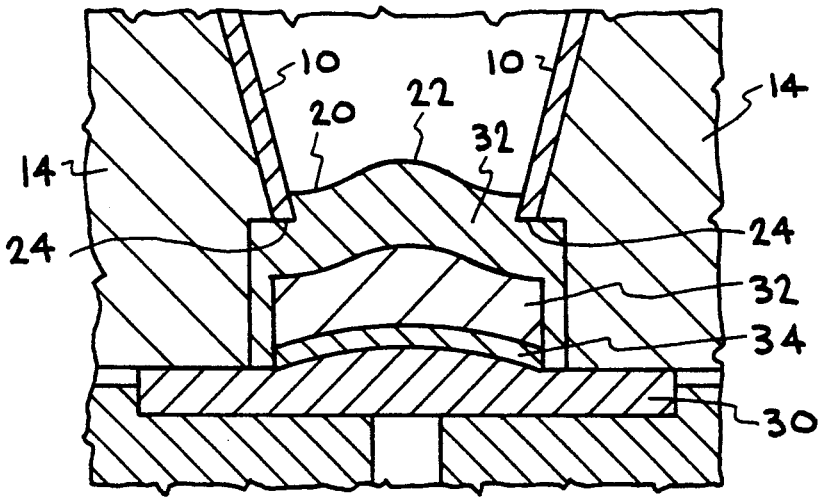
FIG. 2A (PRIOR ART)
FIG. 2A is an enlarged view of a fragmentary portion of FIG. 2, showing the central bulginq of the prior art disc and the gouging of the inner liner into the surface of the prior art disc as the inner liner collapses.

In accordance with the invention, disc means 60 comprises a material which will resist distortion thereof by the detonation, at least until the collapse or implosion of truncated inner liner 50 is complete, and which will provide a slide surface 62 on the upper surface of disc mean 60 which will permit end edges 52 of inner liner 50 to slide thereon during such implosion. That is, gouging of end edges 52 of inner liner 50 into slide surface 62 of disc means 60, as in the prior art structure of FIGS. 1, 2, and 2A, will be inhibited by the disc means of the invention.

This is achieved by forming disc means 60 from a material which has at least one, and preferably two or more of the following characteristics: (1) a higher hardness than the material comprising inner liner 50, e.g., a higher Brinell hardness number; (2) a higher compressive strength than inner liner material 50; and/or (3) a higher density than the density of inner liner material 50. Constructing disc 60 of a material having a combination of these characteristics ensures that disc 60 will be capable of resisting distortion prior to collapse of the liner.

Thus, for example, if inner liner 50 is constructed of aluminum, or an aluminum alloy constituting at least 50 wt. % aluminum, disc means 60 may be constructed of a steel material, since steel possesses all three of the above characteristics, i.e., has a higher hardness than an aluminum alloy, has a higher compressive strength, and has a higher density. In a preferred embodiment, disc means 60 is constructed of tungsten, since tungsten will have a higher hardness, compressive strength, and density than virtually any material of which inner liner 50 may be constructed.

Disc means 60 of the invention, comprising such a material, relative to the properties of inner liner 50, will comprise a disc means which will not rupture or distort, at least prior to the inner collapse or implosion of inner liner 50. Furthermore, disc means 60 will have a surface thereon which will permit end edges 52 of inner liner 50 to freely slide thereon during the implosion, so that disc means 60 will not interfere with the formation of the desired plume or jet as the walls of inner liner 50 converge or intersect adjacent end edges 52.

Figure 8:
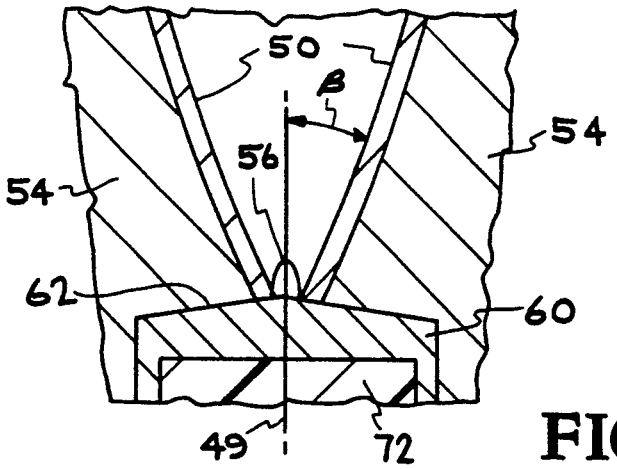

This is shown sequentially in the fragmentary views of FIGS. 4–8 wherein the end edges 52 of inner liner 50 are shown freely sliding inwardly over slide surface 62 of disc means 60 as high explosive 54 continues to burn and inner liner 50 implodes into itself, culminating in the formation of jet or plume 56 shown in FIG. 8.

While the material characteristics of disc means 60, relative to the material characteristics of the type of material used for liner 50, comprises the principal feature of the invention, the shape or slope of slide surface 62 forms a further portion of the present invention, since the angle of the slope of slide surface 62 can permit further control of the formation and nature of the jet or plume formed by the implosion or collapse of inner liner 50. This was not possible in the prior art since the bulging of prior art disc means 20, as well as the gouging of the surface thereof by the end edges of inner liner 10, as shown at 24 in prior art FIGS. 2 and 2A, resulted in an uncontrolled formation of the prior art jet or plume.

The slope or shape of slide surface 62 of disc means 60 will be influenced by the design of the particular explosive device 42. In he design of such open apex shaped charge-type devices, sloped liner 50 forms an initial angle with center axis 49 of the device, which is illustrated as angle "a" in FIG. 3, and which is sometimes is referred to as the "half angle" of inner liner 50. The $\beta$ angle, or collapse angle, of device 42 is defined as the final angle of inner liner 50 with vertical axis 49 at the point of contact between the imploding walls of liner 50, as shown in FIG. 8. The difference between these two angles is referred to as the bending angle, i.e., the extent of the bending of inner liner 50, adjacent disc means 60, from initial angle a to the final $\beta$ collapse angle during the implosion of inner liner 50.

Figure 10:
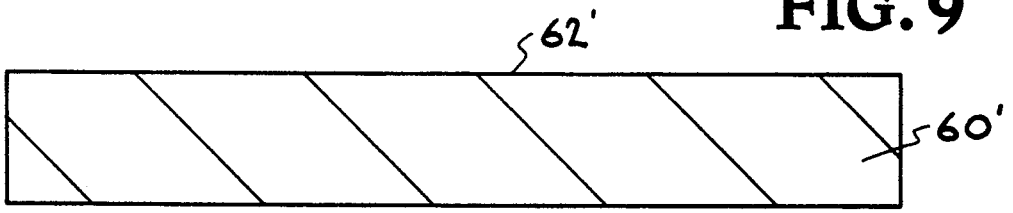
FIG. 10 is a vertical cross-sectional view of another embodiment of the slide surface disc means of the invention.

The extent or value of the $\beta$ angle is important because this is related to the mass and/or velocity of the jet formed. If the $\beta$ angle is almost vertical, i.e., forms an angle with central axis 49 of the device approaching 0°, the velocity will be maximized, but the mass will be less. Conversely, as the $\beta$ angle increases, the velocity of the jet decreases, but the mass of material in the jet increases. Generally, very small collapse or $\beta$ angles, i.e., angles of less than about 5° to about 10°, can be unstable, so it is desirable to increase the $\beta$ or collapse angle to a value above about 10°. The relationships between angle a, the $\beta$ angle, and the bending angle may be expressed as:

(1) angle $\beta$ = angle a + bending angle or (2) bending angle = angle $\beta$ − angle a In the simplest instance, disk means 60 may be provided with a flat surface, as shown in FIG. 10, wherein the disc means of the invention is illustrated at 60' having a flat surface 62' thereon, i.e., a surface forming a 90° angle with vertical axis 49 of device 42 (which is synonymous with the respective vertical axes of inner liner 50 and disc means 60). In such an embodiment, very little, if any control of the extent or amount of change from angle a to angle $\beta$ is exercised, although, as previously discussed, the provision of a disc means 60 formed, in accordance with the invention, of a material having a higher hardness, compressive strength, and density than the liner material, will prevent the occurrence of uncontrollable events (such as bulging of the disc means or gouging of the surface by the inner liner end edges) which would detrimentally affect the desired implosion.

Figure 9:
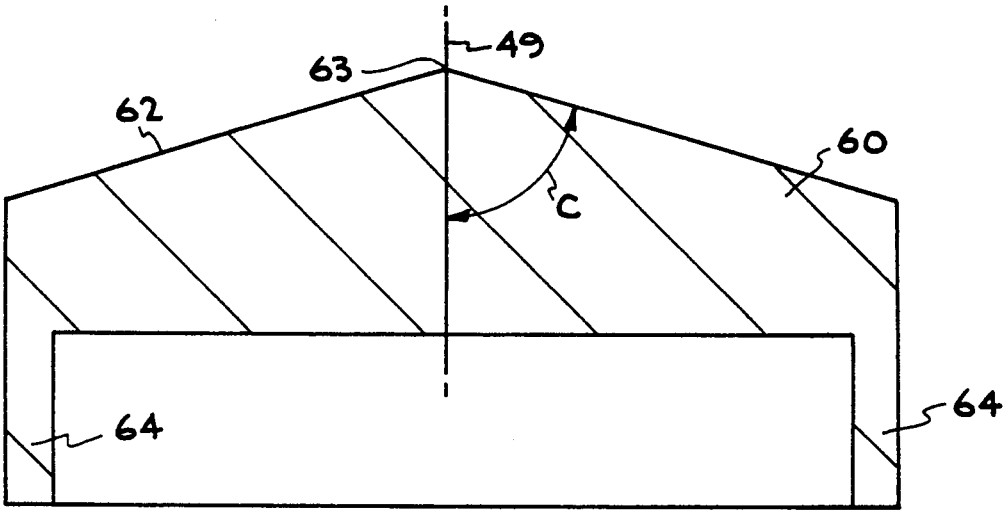
FIG. 9 is a vertical cross-sectional view of the slide surface disc means of the invention shown in the device of FIG. 3.

Preferably, however, as shown in FIG. 9, slide surface 62 will form an angle c with vertical axis 49 of disc means 60 and inner liner 50. Angle c, i.e., the slope of slide surface 62, with respect to vertical axis 49 of disc means 60 and inner liner 50, may vary from the 90° embodiment illustrated in FIG. 10 to an angle which is the sum of the initial half angle a of inner liner 50 plus twice the final bending angle of inner liner 50 as contact is made between the imploding walls of inner liner 50. Angle c may, therefore, be define as:

(3) angle c = angle a + 2(bending angle)

Rewriting equation (3) to substitute equation (2) for the bending angle in equation (3) results in:

(4) angle c = angle a + 2(angle $\beta$ − angle a)

or (5) angle c = 2(angle $\beta$) − angle a

Thus the slope or angle c of slide surface 62, with respect to vertical axis 49 of disc means 60 may vary from 90° to twice angle $\beta$ minus angle a.

Figure 11:
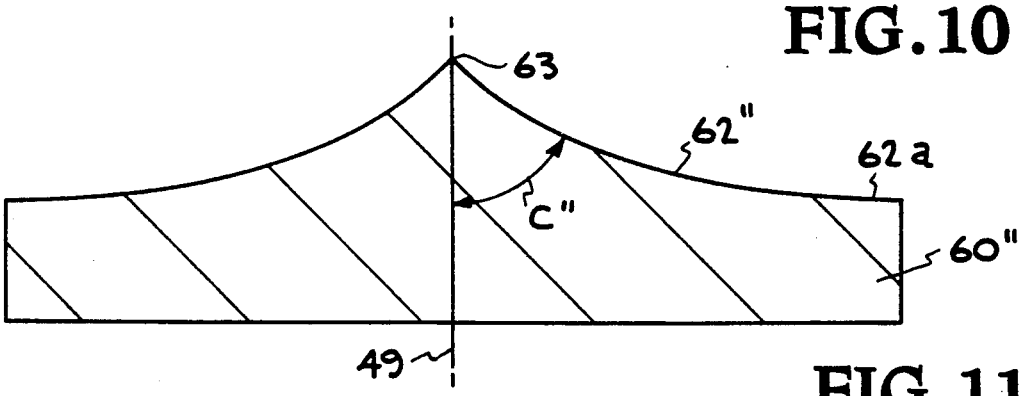
FIG. 11 is a vertical cross-sectional view of the preferred embodiment of the slide surface disc means of the invention.

While the above generally defines the range of the slope of slide surface 62, as shown in FIGS. 3 and 9, slide surface 62 preferable is not linear, but rather may define a somewhat concave surface or slope, as shown at 62" in FIG. 11. Such a surface may begin as a flat slope at **62*a* and then commence into a more concavely sloped curved surface for the remainder of the distance to the apex 63. In such an instance, slope angle a would be defined as the angle which the slope of surface 62" defines with vertical axis 49 of disc means 60 at apex 63. The optimum curvature for surface 62"** may be determined numerically from computer simulations or empirically based on the observed results.

As mentioned previously, while the presence or absence of compressible material 72 behind disc means 60 forms no part of the present invention, the use of such a compressible material, in combination with the disc means of the invention, as well as with the optional provision of steel plate 74 behind such compressible material 72, to evenly spread such cushioning of the upward forces across the surface of compressible material 72, should not be deemed to be excluded.

Thus, the open apex shaped charge-type explosive device of the invention comprises a disc means 60 having certain material characteristics, relative to the material characteristics of the inner liner material to permit formation of a slide surface on the disc means which will permit the end edges of the inner liner to slide thereon during implosion and collapse of the inner liner; and preferably the disc means is further provided with a particular geometric shape of the slide surface thereon to provide further control of the $\beta$ or collapse angle of the inner liner.

While specific embodiments of the disc means and slide surface thereon of the invention have been illustrated and described for providing the improved open apex shaped charge-type explosive device, in accordance with this invention, modifications and changes of the apparatus, parameters, materials, etc. will become apparent to those skilled in the art, and it is intended to cover in the appended claims all such modifications and changes which come within the scope of the invention.

What is claimed is:

1. An open apex shaped charge explosive device comprising:

(a) an inner liner within said device defining a cone truncated at one end thereof;

(b) explosive materials within said device surrounding the outer surface of said inner liner;

(c) disc means within said device having a slide surface located adjacent said truncated end of said inner liner on which the end of said truncated end of said inner liner will slide during detonation; and (d) a primer charge within said device adjacent an opposite surface and the end edge of said disc means whereby said disc means will direct the detonation of said primer charge around said end edge of said disc means to said explosive materials surrounding said inner liner;

said slide surface on said disc means facilitating collapse of said inner liner by allowing said truncated end of said inner liner to slide on said slide surface as said explosive material surrounding said inner liner detonates.

2. The open apex shape charge explosive device of claim 1 wherein said disc means further comprises a material capable of resisting distortion during said detonation until collapse of said inner liner.

3. The open apex shape charge explosive device of claim 1 wherein said disc means further comprises a material having a higher compressive strength than the material comprising said inner liner.

4. The open apex shape charge explosive device of claim 1 wherein said disc means further comprises a material having a higher surface hardness than the material comprising said inner liner.

5. The open apex shape charge explosive device of claim 1 wherein said disc means further comprises a material having a higher density than the material comprising said inner liner.

6. The disc means of claim 1 wherein said slide surface on said disc means defines a slanted surface between the vertical axis of said device and said end edge of said disc means.

7. The open apex shape charge explosive device of claim 1 wherein said slide surface on said disc means defines a concavely curved surface between the vertical axis of said device and said end edge of said disc means.

8. The open apex shape charge explosive device of claim 1 wherein said slide surface on said disc means forms an angle with the vertical axis of said inner liner which may vary from 90° to about the sum of the half angle which said inner liner defines with the axis of said inner liner plus twice the bending angle of said inner liner as said inner liner collapses.

9. An open apex shape charge explosive device having an inner liner defining a truncated cone with disc means located between said inner liner and a primer charge for directing the detonation of the primer charge around the end edge of said disc means to explosive materials surrounding said inner liner, and a slide surface on said disc means capable of facilitating collapse of said inner liner as said explosive material surrounding said inner liner detonates, said slide surface on said disc means forming an angle $\beta$ with the vertical axis of said inner liner having a slope angle or surface which will result in a angle equivalent to the theoretical $\beta$ angle which would result when said imploding inner liner walls meet at the apex of said disc means if said inner liner was a complete cone.

10. An open apex shaped charge explosive device comprising:

(a) an inner liner within said device defining a cone truncated at one end thereof;

(b) explosive materials within said device surrounding the outer surface of said truncated inner liner;

(c) a primer charge within said device;

(d) disc means within said device located between said truncated end of said inner liner and said primer charge for directing the detonation of said primer charge around the end edge of said disc means to said explosive materials surrounding said outer surface of said inner liner, said disc means comprising a material having one or more of the following characteristics:

(i) a higher compressive strength;

(ii) a higher hardness; or (iii) a higher density;

than the material comprising said inner liner, whereby said disc means material will be capable of resisting distortion during said detonation until collapse of said inner liner; and (e) a slide surface on said disc means facing the end edge of said truncated end of said inner liner on which said end edge of said inner liner will slide during collapse of said inner liner as said explosive material surrounding said inner liner detonates.

11. The open apex shape charge explosive device of claim 10 wherein said disc means further comprises a material having both a higher compressive strength and a higher hardness than the material comprising said inner liner, whereby said disc means is capable of resisting distortion during said detonation until collapse of said inner liner.

12. The open apex shape charge explosive device of claim 10 wherein said disc means further comprises a material having both a higher compressive strength and a higher density than the material comprising said inner liner, whereby said disc means is capable of resisting distortion during said detonation until collapse of said inner liner.

13. The open apex shape charge explosive device of claim 10 wherein said disc means further comprises a material having both a higher hardness and a higher density than the material comprising said inner liner, whereby said disc means is capable of resisting distortion during said detonation until collapse of said inner liner.

14. The disc means of claim 10 wherein said slide surface on said disc means defines a slanted surface between the vertical axis of said device and said end edge of said disc means.

15. The disc means of claim 10 wherein said slide surface on said disc means defines a concavely curved surface between the vertical axis of said device and said end edge of said disc means.

16. The disc means of claim 10 wherein said slide surface on said disc means forms an angle with the vertical axis of said inner liner which may vary from 90° to about the sum of the half angle which said inner liner defines with the axis of said inner liner plus twice the bending angle of said inner liner as said inner liner collapses to thereby facilitate collapse of said inner liner as said explosive material surrounding said inner liner detonates.

17. An open apex shaped charge explosive device comprising:

(a) an inner liner within said device defining a cone truncated at one end thereof;

(b) explosive material within said device surrounding the outer surface of said truncated inner liner;

(c) a primer charge within said device;

(d) disc means within said device located between said truncated end of said inner liner and said primer charge for directing the detonation of said primer charge around the end edge of said disc means to said explosive materials surrounding said outer surface of said inner liner, said disc means comprising a material having two or more of the following characteristics;

(i) a higher compressive strength;

(ii) a higher hardness; or (iii) a higher density;

then the material comprising said inner liner, whereby said disc means material will be capable of resisting distortion during said detonation until collapse of said inner liner; and (e) a slide surface on said disc means facing the end edge of said truncated end of said inner liner on which said end edge of said inner liner will slide during collapse of said inner liner as said explosive material surrounding said inner liner detonates.

18. The disc means of claim 17 wherein said slide surface on said disc means defines a surface slanted upwardly from said end edge of said disc means toward the vertical axis of said disc means.

19. The disc means of claim 18 wherein the slope of said slide surface with respect to said vertical angle of said disc means varies from just under 90° to 2(angle $\beta$)−angle a, where angle $\beta$ is the final angle of said collapsing inner liner with respect to said vertical axis of said disc means at the point of contact between the imploding walls of said inner liner, and angle a is the initial angle of said inner liner with said vertical axis of said disc means.

20. The disc means of claim 17 wherein said slide surface on said disc means defines a concavely curved surface commencing at said end edge of said disc means and curving upwardly toward said vertical axis of said disc means.

* * * * *